US007503834B2

(12) United States Patent
Kuebler et al.

(10) Patent No.: US 7,503,834 B2
(45) Date of Patent: Mar. 17, 2009

(54) APPARATUS AND A METHOD OF POLISHING AN OPTICAL SURFACE; AN OPTICAL COMPONENT; AND A METHOD OF MANUFACTURING A POLISHING TOOL

(75) Inventors: Christoph Kuebler, Oberkochen (DE); Hexin Wang, Koenigsbronn (DE)

(73) Assignee: Carl Zeiss Vision GmbH, Aalen (DE)

( * ) Notice: Subject to any disclaimer, the term of this patent is extended or adjusted under 35 U.S.C. 154(b) by 0 days.

(21) Appl. No.: 11/485,578

(22) Filed: Jul. 12, 2006

(65) Prior Publication Data

US 2007/0021036 A1 Jan. 25, 2007

Related U.S. Application Data

(63) Continuation of application No. PCT/EP2005/000278, filed on Jan. 13, 2005.

(30) Foreign Application Priority Data

Jan. 15, 2004 (DE) ..... 10 2004 003 131

(51) Int. Cl.
*B24B 13/00* (2006.01)

(52) U.S. Cl. ..... 451/42; 451/526

(58) Field of Classification Search ..... 451/42, 451/921, 533, 538, 526, 544
See application file for complete search history.

(56) References Cited

U.S. PATENT DOCUMENTS

| | | | | |
|---|---|---|---|---|
| 3,043,065 A | | 7/1962 | Terrel | |
| 4,707,949 A | * | 11/1987 | Hellstrom | 451/42 |
| 5,357,716 A | | 10/1994 | Kishida et al. | |
| 2003/0017783 A1 | | 1/2003 | Bernard et al. | |

FOREIGN PATENT DOCUMENTS

| | | |
|---|---|---|
| DE | 44 42 181 C1 | 10/1995 |
| DE | 296 08 954 U1 | 1/1997 |
| DE | 101 00 860 A1 | 8/2001 |
| DE | 101 06 007 A1 | 8/2002 |
| DE | 101 06 659 A1 | 8/2002 |
| DE | 102 42 422 A1 | 4/2003 |
| DE | 102 48 104 A1 | 5/2003 |
| DE | 102 48 105 A1 | 5/2003 |
| EP | 0 366 051 | 5/1990 |
| EP | 0 567 894 A1 | 11/1993 |
| EP | 0 779 128 A1 | 6/1997 |
| EP | 0 804 999 A2 | 11/1997 |

(Continued)

*Primary Examiner*—Robert Rose
(74) *Attorney, Agent, or Firm*—Harness, Dickey & Pierce, P.L.C.

(57) ABSTRACT

An apparatus for polishing an optical surface, in particular an optical surface of a spectacle lens, is disclosed. The apparatus comprises a polishing head having a polishing tool, the polishing tool being provided along a common axis, one behind another, with a first preferably rigid member, a second elastic member, and a polishing lining, each extending essentially radially relative to the axis. The second elastic member is configured to be increasingly soft in a radial outward direction. Moreover, a method of polishing an optical surface, in particular a surface of a spectacle lens, an optical component manufactured according to that method, in particular a spectacle lens, as well as a method of manufacturing a polishing tool are disclosed.

17 Claims, 5 Drawing Sheets

FOREIGN PATENT DOCUMENTS

| | | | |
|---|---|---|---|
| EP | 0 884 135 | A2 | 12/1998 |
| EP | 1 327 496 | | 7/2003 |
| JP | 61-100358 | | 5/1986 |
| JP | 61-103768 | | 5/1986 |
| JP | 8-206952 | | 8/1996 |
| JP | 2001-334449 | | 12/2001 |
| WO | 03/059572 | A1 | 7/2003 |

* cited by examiner

APPARATUS AND A METHOD OF POLISHING AN OPTICAL SURFACE; AN OPTICAL COMPONENT; AND A METHOD OF MANUFACTURING A POLISHING TOOL

CROSS REFERENCES TO RELATED APPLICATIONS

The present application is a continuation of international patent application PCT/EP2005/000278 filed on Jan. 13, 2005 and published in German language, which international patent application claims priority under the Paris Convention from German patent application DE 10 2004 003 131.2, filed Jan. 15, 2004.

FIELD OF THE INVENTION

The present invention, generally, is related to the field of polishing optical surfaces.

More specifically, the invention is related to an apparatus for polishing an optical surface, comprising a polishing head having a polishing tool, the polishing tool being provided along a common axis, and one behind another, with a first, preferably rigid member, a second, elastic member, and a polishing lining, each extending essentially radially relative to the axis.

The invention, further, is related to a method of polishing an optical surface.

The invention, moreover, is related to an optical component.

The invention, finally, is related to a method of manufacturing a polishing tool, the polishing tool being provided along a common axis, and one behind another, with a first, preferably rigid member, a second, elastic member, and a polishing lining, each extending essentially radially relative to the axis.

BACKGROUND OF THE INVENTION

If, in the context of the present invention, the term "optical surfaces" is used, this is to be understood to mean all such surfaces of optical components, as, for example, surfaces, in particular aspheric surfaces or free-form surfaces, of spectacle lenses, mirrors, plastic material optics, etc.

An apparatus and a method of the type specified at the outset are known from document DE 102 48 105 A1.

Spectacle lenses are conventionally manufactured from a blank by chip-removing machining of the so-called prescription surface or surfaces. The optically relevant shape of the spectacle lens is thus determined. Finally, the spectacle lens is polished, however, the polishing shall not effect a noticeable change of the optical characteristics.

For polishing a surface of a spectacle lens, a polishing head is conventionally used having a polishing tool, the polishing surface of which being at least approximately adapted to the shape of the surface of the spectacle lens to be polished. The polishing tool and/or the spectacle lens are gimballed, in particular by means of a ball joint, and are guided relative to one another along a predetermined motional sequence, mostly with the assistance of multi-axis robots.

Due to the relatively simple shape of the surface to be polished, it presents much less of a problem for polishing spheric or toric spectacle lenses to find an appropriate polishing tool of complementary shape that may be guided over the surface with relatively simple motional sequences, and without effecting unwanted deformations. Due to the high number of potential spheric or toric spectacle lenses it is only necessary to have a corresponding plurality of polishing tools at hand.

In this context, various groups of polishing tools have become known.

In a first group of such polishing tools (DE 101 00 860 A1; EP 0 567 894 B1), a rigid polishing member is always used, which is once for ever adapted to the shape of the surface to be polished, and, hence, may be used only for that particular surface.

In a second group of such polishing tools (DE 44 42 181; DE 102 42 422), a polishing member is used which, in operation, is rigid, however, which is initially transformed into a plastic state, for example by warming, so that it may adapt to any conceivable surface in that plastic state, before it again solidifies.

These two groups of polishing tools, hence, have in common that they are rigid in operation and, therefore, may be used only for polishing regularly shaped surfaces.

In a third group of polishing tools (EP 0 804 999 B1; EP 0 884 135 B1; DE 101 06 007 A1), a polishing body is provided which may be deformed also during operation. The deformability is affected by a bundle of parallel metallic rods which, at one end thereof, are journaled on an elastic membrane, and which may be displaced individually. The integral surface defined by their terminal surfaces at their other end is adapted to the shape of the surface to be polished.

These polishing tools, on the one hand, have the disadvantage that the membrane, as any such membrane, has a function of elasticity in which the center is the softest point with the elasticity decreasing in a radial outward direction, i.e. the membrane becomes stiffer close to its rim, or, the elasticity function has an increasing gradient. This, however, is disadvantageous for polishing tools of the type of interest in the present context, as was found out in the scope of the present invention, because this elasticity function gives rise to substantial deviations in shape. On the other hand, these polishing tools have the disadvantage that the displacement of the rods gives rise to mechanical friction, such that dynamic polishing processes may not be executed in practice.

In a fourth group of polishing tools (EP 0 779 128 B1; Patent Abstracts of Japan re. JP 08-206 952 A), polishing members are used having a pneumatically deformable polishing body. In that case, however, one has the same disadvantages in connection with an unfavorable elasticity function.

In a fifth group of polishing tools (DE 101 06 659 A1; DE 102 48 105 A1; DE 102 48 104 A1; US 2003/0017783 A1; WO 03/059572 A1), a member from an elastic material is provided in a polishing tool between a rigid base member and the polishing lining.

In these prior art polishing tools, however, the axial thickness of the elastic member is constant and the material of the elastic member is homogeneous. Accordingly, the elasticity is constant in a radial direction.

Insofar, with regard to prior art polishing tools for the machining of optical surfaces, in particular of spectacle lenses, one may state that the radial function of the pressure stiffness either increases in a radial outward direction, or is constant.

For relatively simply shaped surfaces (spheric or toric surfaces), this is sufficient. However, for the polishing of aspheric or non-point-symmetric free-form surfaces, respectively, such polishing tools may not be used without incurring problems.

Such free-form surfaces are conventionally also polished by means of numerically controlled polishing machines or polishing robots. In these machines, the polishing tool is guided over the spectacle lens surface to be polished by means of CNC. The polishing head drives the polishing tool mostly in a rotational movement, and, concurrently, applies same under pressure against the surface to be polished.

Aspheric or non-point-symmetric surfaces have curvatures which change over the surface. The polishing tool, during the polishing machining, moves over at least a portion of this irregularly curved surface. Therefore, it must be able to adapt with its elasticity to the prevailing local curvature, namely such that the polishing pressure is constant, if possible, over the contact surface. Only then one has a predeterminable constant removal of material, and the polished surface becomes entirely even. If this cannot be guaranteed, and the polishing pressure varies over the contact surface, then the desired aspheric surface topography is deformed and, consequently, its optical quality is reduced. Such deformations occur with prior art polishing tools in conventional production processes and, therefore, must be compensated stepwise, i.e. with iterative post-processing methods. This, however, is time and cost consuming.

With regard to the general prior art of polishing tools, one should mention DE 296 08 954 U1. This document describes an adaptive polishing head for being chucked in rotating tools. The polishing head comprises a base member being coated with a polishing material. The base member may consist of a soft, extremely elastic material, for example foam rubber. The polishing head, in an axial sectional view, has the shape of a mushroom, a cone or a ball, which means that it is thinner in the peripheral area, as compared to its center. Therefore, it is harder in its peripheral area.

A similar polishing head is also disclosed in U.S. Pat. No. 3,043,065. this prior art polishing head is mushroom-shaped and, hence, is likewise harder in its peripheral area, as compared to its center.

Finally, Patent Abstract of Japan re. JP 61-103 768 A also describes a polishing head of likewise mushroom-shaped figuration. This polishing head is subdivided into three concentric areas consisting of the same material, however, having air bubbles embedded therein in different concentrations. The central area has the maximum density of air bubbles, such that the effectively removed surface is at a minimum. It is at a maximum in the peripheral area.

SUMMARY OF THE INVENTION

It is, therefore, an object underlying the invention to improve an apparatus, a method, and an optical component, in particular a spectacle lens, of the type specified at the outset, such that these disadvantages are avoided. In particular, it shall become possible to polish spectacle lenses with irregularly curved free-form surfaces by means of tools of simple design, and in a surface quality which makes any post-processing unnecessary.

In an apparatus of the type specified at the outset, this object is achieved in that the second member is configured to be increasingly soft in a radial outward direction.

In a method for polishing an optical surface of the type specified at the outset, this object is achieved in that an apparatus of the type specified before is used.

In an optical component of the type specified at the outset, this object is achieved according to the present invention in that the component is manufactured according to the method specified before.

In a method for manufacturing a polishing tool of the type specified at the outset, this object is achieved in that the second member is configured to be increasingly soft in a radial outward direction.

The object underlying the invention is thus entirely solved.

The invention, namely, provides an astonishingly simple polishing tool being similar in its structure to prior art polishing tools, however, due to its configuration is able to polish irregularly curved free-form surfaces of spectacle lenses, in contrast to prior art polishing tools, without generating an irregular removal of material during polishing. This is achieved by specially influencing the radial direction of the elasticity of the elastic member carrying the polishing lining, in that the elastic member is configured to be increasingly soft in a radial outward direction, i.e. having a curve of elasticity becoming increasingly flatter.

In a preferred embodiment of the apparatus according to the invention, the second member is configured to be continuously increasingly soft in a radial outward direction.

This measure has the advantage that the application force is particularly homogenously transferred to the surface to be polished.

As an alternative, however, the second member may also be configured to be discontinuously increasingly soft in a radial outward direction.

It is particularly preferred, when the second member is configured to have an increasing axial thickness in a radial direction.

This measure has the advantage that the desired radial stiffness profile may be set almost arbitrarily, if the radial profile of the axial thickness is set accordingly. In such a manner, the tool may be delicately optimized.

In a particularly preferred variant of the last-mentioned embodiment, the second member adjoins the first member with an inner contour, and adjoins the polishing lining with an outer contour, the function of the axial thickness vs. the radial direction being determined depending on the radial function of the contours.

This measure has the advantage that an optimization with two contours becomes possible, such that the outer contour may be optimally adapted to the surface to be polished, whereas the inner contour may essentially be used for setting the desired radial profile.

For the particular shape of the contours, there are various preferred possibilities, always depending on the particular surface to be polished:

Insofar, the inner contour may be convex and the outer contour may likewise be convex, or, the inner contour may be convex and the outer contour plane, or, the inner contour may be concave and the outer contour concave, or, the inner contour may be plane and the outer contour concave, or, the inner contour may be convex and the outer contour concave.

Moreover, it is preferred when the outer contour is spheric or aspheric or configured as a free-form surface.

In a practical embodiment, the second member consists of a material having a modulus of elasticity of more than 0.02 $N/mm^2$.

This range of elasticity has turned out to be optimal during practical tests.

For what concerns the selection of materials, it is preferred for the second member, if the latter is selected from the group consisting of rubber, caoutchouc, polyurethane, polyetherurethane, elastomer.

A particularly economic manufacture becomes possible, when the second member is a molded piece.

Another embodiment of the invention is wherein the second member is configured from a material having an elasticity increasing outwardly in a radial direction, i.e. the pressure elasticity curve becomes increasingly flatter in a radial outward direction.

This measure has the advantage that one is free within a large range, to select the shape of the second member. One can, therefore, configure the second member to have a constant thickness, i.e. can configure same as a circular disc, while still having the desired radial elasticity profile in which the second member is increasingly softer in a radial outward direction, due to the particular inhomogeneous characteristics of the material.

Therefore, as already mentioned, the second member may preferably have a constant axial thickness in a radial direction.

If, in the context of the present application, the term "polishing lining" is mentioned, this is to be understood to mean any configuration being able to configure a polishing surface.

Therefore, the polishing lining may, preferably, be just a polishing paste, or may be physically configured as a polishing membrane, a polishing pad, or a polishing material layer.

As has already been mentioned, the present invention is preferably related to the polishing of surfaces of spectacle lenses or mirrors or aspheric mirrors or aspheric optical surfaces.

According to embodiments of the invention, the polishing tool, insofar, may either be round with respect to its axis or may be out of round. It may, further, be gimballed in the axis or outside the axis.

In a particularly preferred embodiment of the inventive method of manufacturing a polishing tool, the second member is manufactured with an axial thickness increasing in a radial direction, wherein the second member is manufactured to adjoin the first member with an inner contour, and to adjoin the polishing lining with an outer contour, wherein the function of the axial thickness vs. the radial direction is determined depending on the radial function of the contours.

These measures have the already above-mentioned advantage that the desired radial profile of the elasticity may be exactly set.

For a reduction into practice, the invention, insofar, provides two variants:

The first variant is characterized by the following steps:

a) Determining a desired medium polishing pressure pm of the polishing tool;
b) Determining the necessary application force Fk from the polishing area of the polishing tool,
c) Selecting a modulus of elasticity E for the material of the second member;
d) Selecting a central thickness Di of the second member;
e) Selecting an initial outer contour;
f) Calculating a central elastic deflection di for a second member under the assumption that the second member has a constant axial thickness D being equal to the central thickness Di;
g) Determining a polishing movement of the polishing tool on the surface to be polished;
h) Subdividing the polishing movement into a predetermined number n of motion increments, the number n being elected sufficiently high;
i) Calculating an elastic deflection area from the deviations of the axial thickness z_Di in the direction z of the axis between the surface and the outer contour in a predetermined point i during a relative polishing movement between the polishing tool and the optical surface;
j) Adding the deviations z_Di at all points i;
k) Determining a maximum deviation z_Dmax;
l) Determining a minimum deviation z_Dmin;
m) Determining a mean value z_Dm from all deviations z_Di;
n) Establishing a difference z_Dmt between the mean value z_Dm and the sum of a tilting and a central offset of the mean value z_Dm;
o) Calculating the axial thickness D as a function of the radial direction h for round and out of round polishing tools, resp., with the sub-steps of:

$$K2(h)=K2(h)+z_Dmt(h);\text{ and} \quad \text{(IV)}$$

$$K2(x,y)=K2(x,y)+z_Dmt(x,y),\ resp.; \quad \text{(V)}$$

$$D(h)=Di+Di*(z_D\max(h)-z_D\min(h))/di/f_a;\text{ and} \quad \text{(VI)}$$

$$\text{(VII)}\ D(x,y)=Di+Di*(z_D\max(x,y)-z_D\min(x,y))/di/f_a,\ resp.; \quad \text{(VII)}$$

$$K1(h)=K2(h)+D(h);\text{ and} \quad \text{(VIII)}$$

$$K1(x,y)=K2(x,y)+D(x,y),\ resp. \quad \text{(IX)}$$

The second variant is characterized by the following steps:

a) Determining a desired medium polishing pressure pm of the polishing tool;
b) Determining the necessary application force Fk from the polishing area of the polishing tool;
c) Selecting a modulus of elasticity E for the material of the second member;
d) Selecting a central thickness Di of the second member;
e) Selecting an initial outer contour;
f) Calculating a central elastic deflection di for a second member under the assumption that the second member has a constant axial thickness D being equal to the central thickness Di;
g) Determining a polishing movement of the polishing tool on the surface to be polished;
h) Subdividing the polishing movement into a predetermined number n of motion increments, the number n being elected sufficiently high;
i) Calculating an elastic deflection area from the deviations of the axial thickness z_Di in the direction z of the axis between the surface and the outer contour in a predetermined point i during a relative polishing movement between the polishing tool and the optical surface;
j) Adding the deviations z_Di at all points i;
k) Determining a maximum deviation z_Dmax;
l) Determining a minimum deviation z_Dmin;
m) Determining a mean value z_Dm from all deviations z_Di;
n) Establishing a difference z_Dmt between the mean value z_Dm and the sum of a tilting and a central offset of the mean value z_Dm;
o) Calculating the axial thickness D as a function of the radial direction h for round and out of round polishing tools, resp., with the sub-steps of:

$$D(h)=Di+Di*z_Dmt(h)/di/f_a;\text{ and}$$

$$D(x,y)=Di+Di*z_Dmt(x,y)/di/f_a,\ resp.;$$

$$K1(h)=K2(h)+D(h);\text{ and}$$

$$K1(x,y)=K2(x,y)+D(x,y),\ resp.$$

Further advantages will become apparent from the description and the enclosed drawing.

It goes without saying that the features mentioned before and those that will be explained hereinafter, may not only be used in the particularly given combination, but also in other combinations, or alone, without leaving the scope of the present invention.

BRIEF DESCRIPTION OF THE DRAWINGS

Embodiments of the invention are shown in the drawing and will be explained in further detail throughout the subsequent description.

DETAILED DESCRIPTION OF THE PREFERRED EMBODIMENTS

Figure 1:
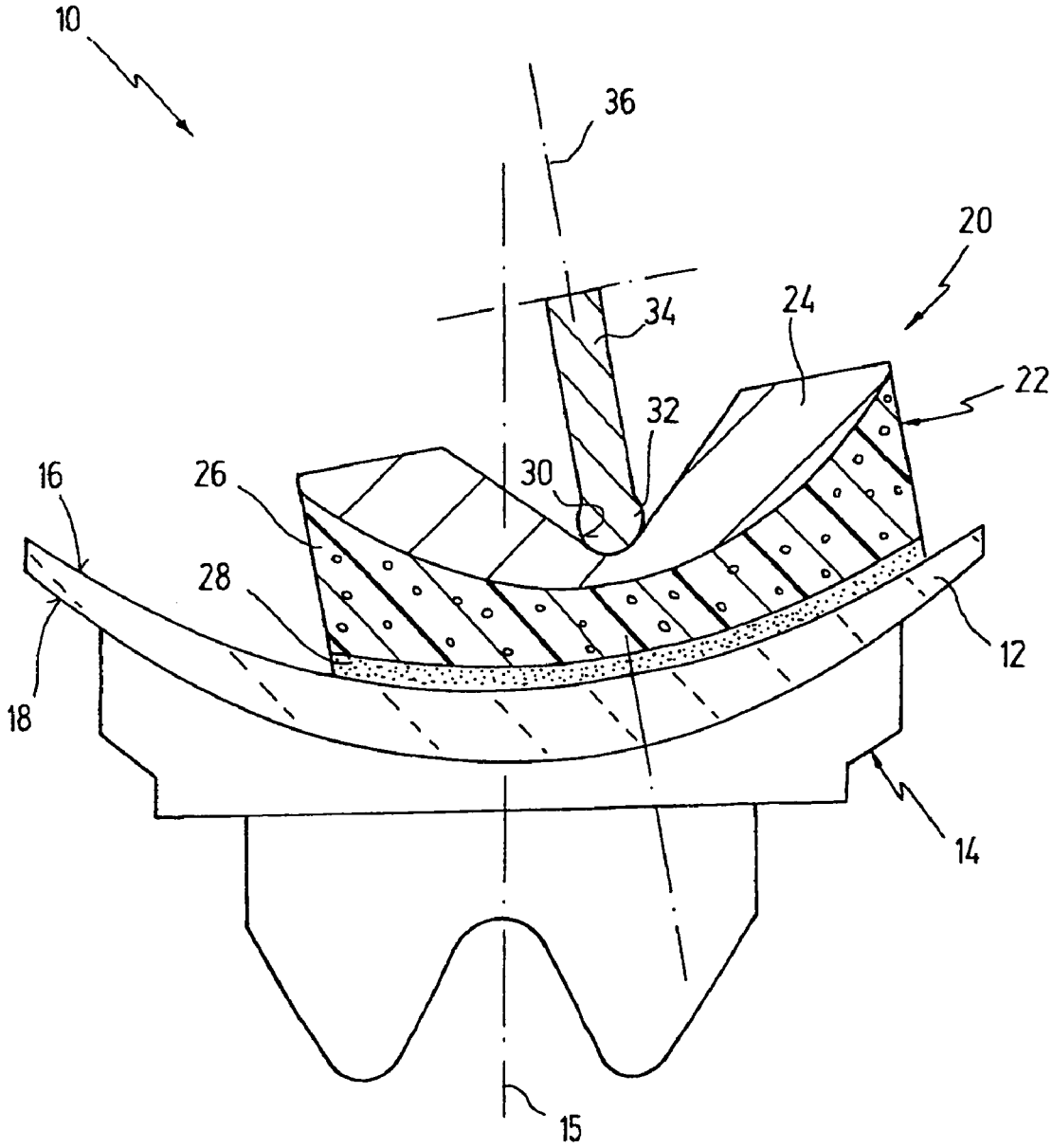
FIG. 1 shows a schematic side-elevational view, partially broken away, of an embodiment of a polishing head for polishing a surface of a spectacle lens, according to the present invention.

In FIG. 1, reference numeral 10 as a whole designates an apparatus for polishing a spectacle lens 12. It goes without saying that the field of application "spectacle lens" shall be understood only as an example because the invention may be used, generally, for optical surfaces. This encompasses surfaces of optical components, as, for example, aspheric surfaces or free-form surfaces of spectacle lenses, mirrors, plastic material optics, etc.

In FIG. 1, spectacle lens 12 is held by a conventional mount 14 which, in the embodiment shown, is stationary. A first axis is designated at 15. It is also the geometric axis of the body of spectacle lens 12, and the vertical axis of mount 14.

Spectacle lens 12 has an inner, rear surface 16 and an outer, front surface 18. Inner surface 16, in the embodiment shown, is the so-called prescription surface which shall be optically machined in a predetermined manner and, in particular, is configured as a free-form surface.

At its free end, the polishing head 20 carries a polishing tool 22. Polishing tool 22 has a first, preferably rigid body or member 24 shaped as a bowl. Member 24 adjoins flushly a second, elastic body or member 26, referred to in the art as "buffer". On the opposite side thereof there is provided a polishing lining 28. Polishing lining 28 may simply consist of a polishing paste applied thereto or may be an individual physical member, for example a polishing membrane, a polishing pad or a polishing material layer.

First member 24 on its rear side is provided with a ball socket 30 or another appropriate joint device. A ball head 32 of an actuator of a polishing robot (not shown) engages ball socket 30 and extends along a second axis 36. The joint, as illustrated, allows pivotal movements of polishing tool 22 relative to spectacle lens 12, and, simultaneously allows to let polishing tool 22 rotate about second axis 36. It is, thereby, possible to drive polishing tool 22 and to guide same with polishing lining 28 over surface 16 of spectacle lens 12 to be polished, as is well-known to a person of ordinary skill in this art.

Second, elastic member 26, preferably, consists of rubber or caoutchouc. However, it may also consist of a polyurethane material, i.e. polyurethane, polyetherurethane, or an elastomer. Such materials are well-known and may, for example, be supplied by the Getzner company under the trade names Sylomer, Sylodyn, and Sylodamp. The modulus of elasticity E of this material should be higher than 0.02 $N/mm^2$.

Elements 24, 26, and 28 are seated along the direction of second axis 36 close to one another and essentially extend in a radial direction. As will be explained in further detail below, one distinguishes in the context of the present invention between round and out of round polishing tools 22.

Further, it should be mentioned, that second axis 36 must not necessarily be arranged within the center of polishing tool 22. Therefore, the present invention also encompasses other embodiments with eccentric or tumbling arrangements.

Figure 2:
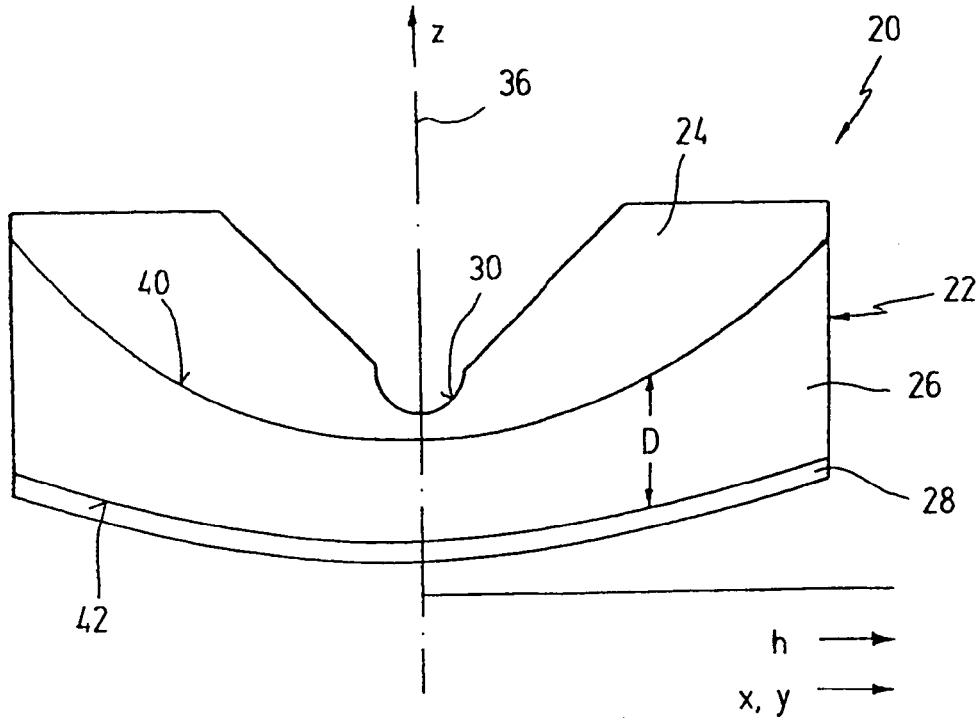
FIG. 2 shows a still further schematized depiction of a polishing tool, as may be used in the polishing head of FIG. 1.

In FIG. 2, polishing tool 22 is again shown schematically with its three elements 24, 26, and 28. It is important for this embodiment that second member 26 has an axial thickness D that varies depending on the distance from axis 36. This is so provided because the elasticity of second member 26 shall increase in a radial outward direction in a predetermined manner, i.e. along a predetermined profile. This means that second elastic member 26 becomes softer outside, i.e. has an increasingly flatter characteristic curve of elasticity. Insofar, one takes advantage of the fact that an elastic flat material has a characteristic curve of elasticity, i.e. a function of pressing ($N/mm^2$) vs. elastic deformation (mm) being the flatter, the thicker the flat material is. During the polishing of an optical surface, the pressing is equal to the exerted polishing pressure.

The axial thickness D, already mentioned, is measured between inner contour 40 and outer contour 42 of second member 26.

For the sake of completeness it should be mentioned at this instance that the desired increasing elasticity at the periphery of the polishing tool may, as an alternative, also be achieved by using a material for the second member with a nonhomogeneous elasticity increasing in a radial outward direction. When doing so, one is to a high degree free to select the axial thickness as a function of the radial distance to the axis.

It should, further, be mentioned that the radial increase of the elasticity towards the periphery of the polishing tool may be set to be continuous, or in steps.

For the further explanation of the embodiment shown in the drawing, the direction of second axis 36 is designated as z. The radial distance from second axis 36 for a round polishing tool 22 is one-dimensional, i.e. h. For out of round polishing tools 22, it is two-dimensional, i.e. is given in coordinates x and y.

FIG. 2, further, shows that second member 26 at its upper side is delimited by inner contour 40 and at its lower side is delimited by outer contour 42. Outer contour 42, essentially, is equal to the envelope of the contour of the surface 16 to be polished. In FIG. 2, inner contour 40 is concave, and outer contour 42 is convex.

FIGS. 3 to 6 show variants of FIG. 2, in which like elements are designated with like reference numerals, and are only differentiated by the addition of a letter.

Figure 3:
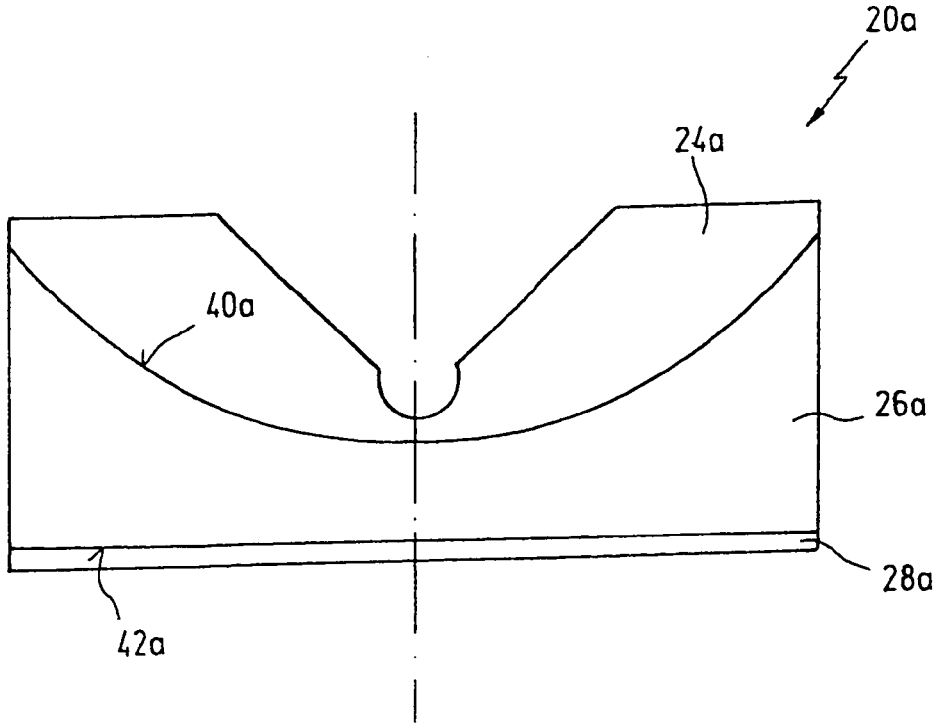
FIG. 3 shows a depiction, similar to that of FIG. 2, however, for a first variant of the polishing tool.

In FIG. 3, inner contour 40*a* is convex, and outer contour 42*a* is plane.

Figure 4:
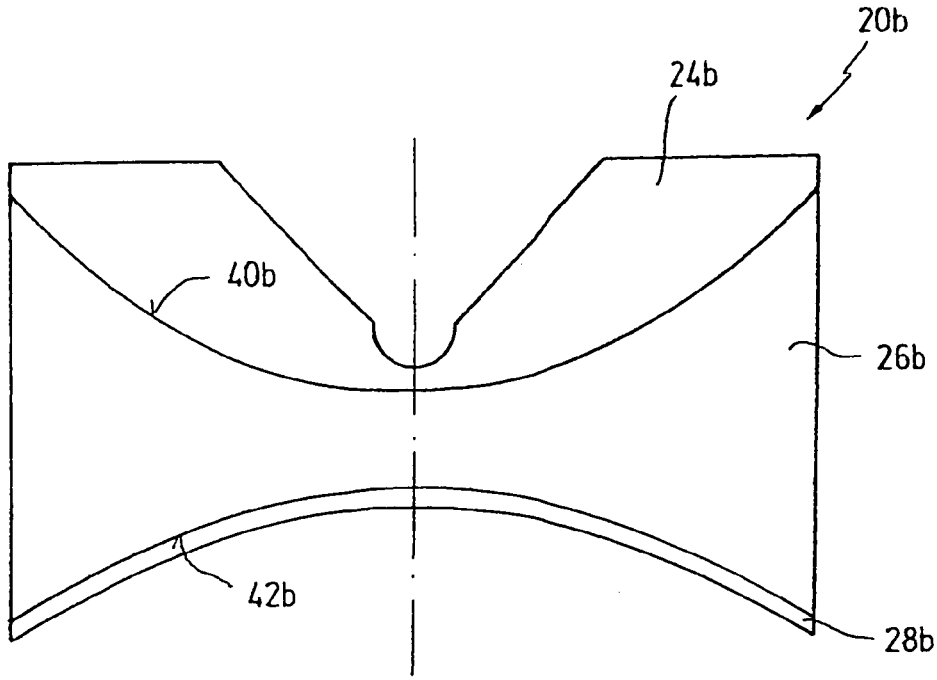
FIG. 4 shows a depiction, similar to that of FIG. 2, however, for a second variant of the polishing tool.

In FIG. 4, inner contour 40*b* and outer contour 42*b* are concave.

Figure 5:
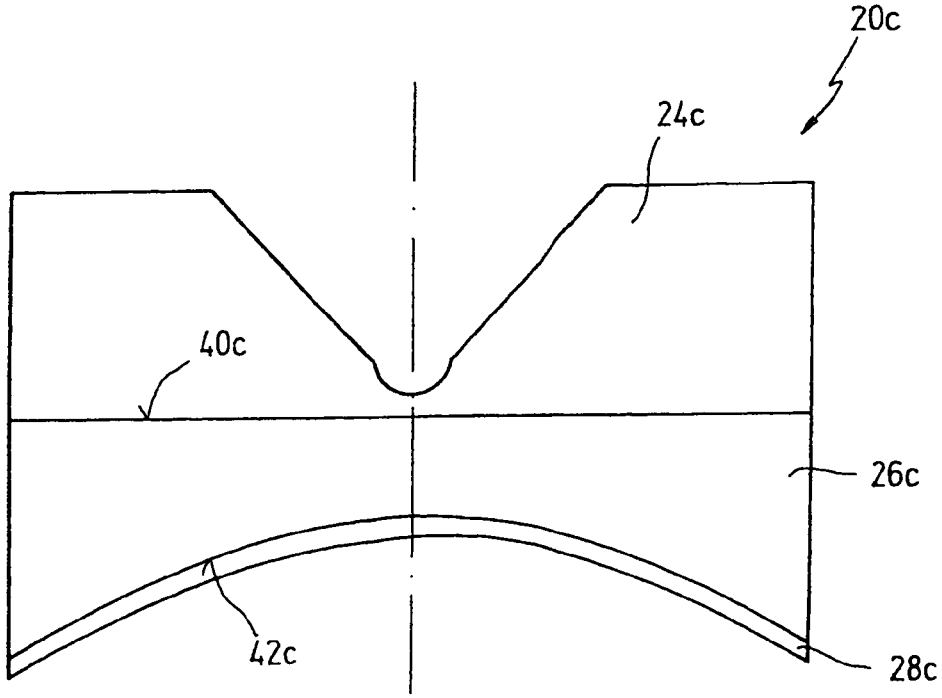
FIG. 5 shows a depiction, similar to that of FIG. 2, however, for a third variant of the polishing tool.

In FIG. 5, inner contour 40*c* is plane, and outer contour 42*c* is concave.

Figure 6:
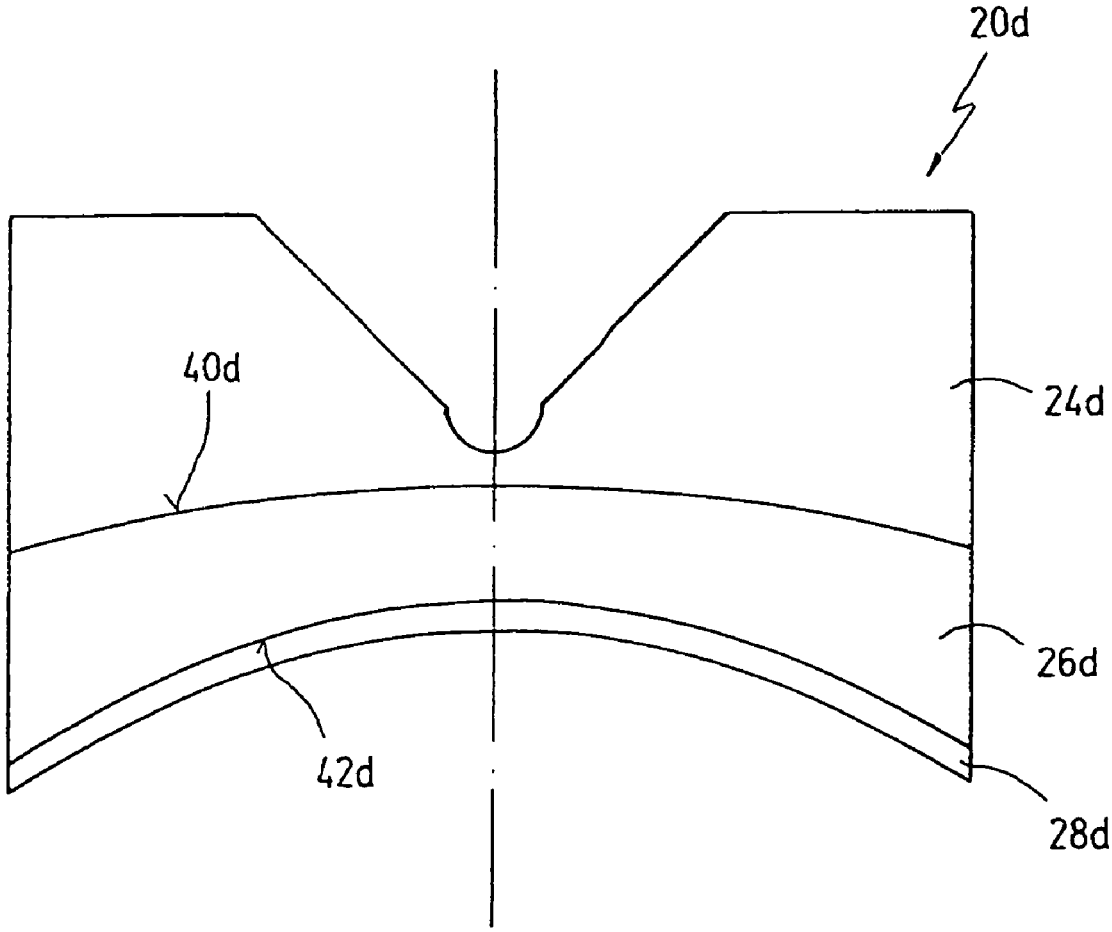
FIG. 6 shows a depiction, similar to that of FIG. 2, however, for a fourth variant of the polishing tool.

In FIG. 6, inner contour 40*d* is convex, and outer contour 42*d* is concave.

Figure 7:
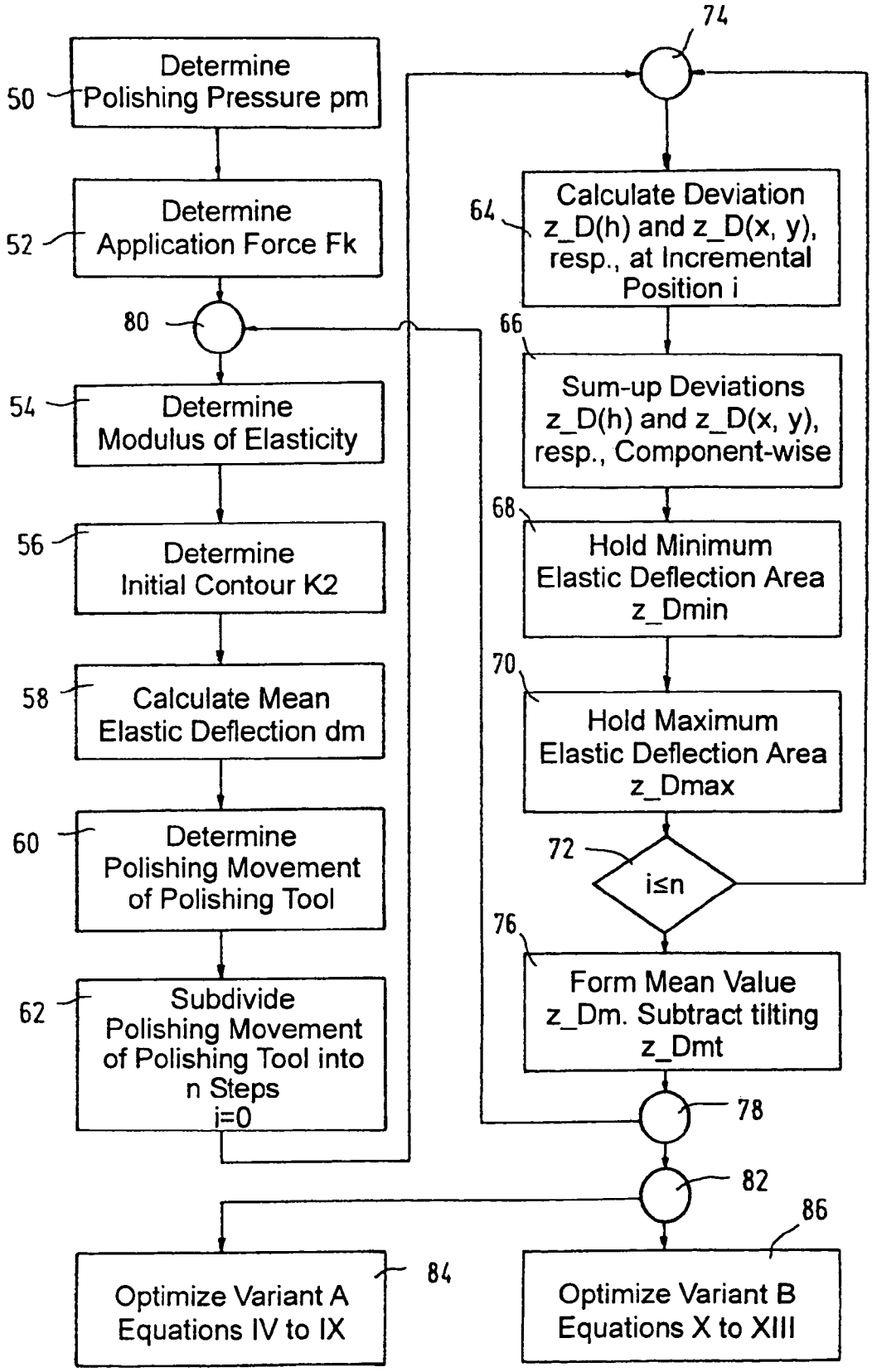
FIG. 7 shows a block diagram for explaining an embodiment of a method for manufacturing a polishing tool, according to the present invention.

Polishing tool 22 is applied against surface 16 to be polished of spectacle lens 12 with an application force Fk. In order to achieve the desired uniform application pressure over the contact surface between polishing lining 28 and surface 16, an optimizing process is executed being illustrated in the block diagram of FIG. 7.

For that purpose, the calculation of the polishing pressure is based on a simplified model of Hooke's Law. This model establishes a one-dimensional context between the polishing pressure p(h) or the surface pressure, resp., for round or for out of round p(x,y) polishing tools 22, resp., and the thickness D(h) or D(x,y), resp., of second member 26:

$$p(h)=E*d(h)/D(h), \text{ and}$$

$$p(x,y)=E*d(x,y)/D(x,y), \textit{ resp.}$$

In a first step (block 50), the desired mean polishing pressure pm or surface pressure is determined in $N/mm^2$.

In a second step (block 52), the necessary application force Fk in N units is determined from the dimensions of polishing tool 22, i.e. from the size of the contact surface.

In a third step (block 54), the modulus of elasticity E of the material is selected for second member 26, and its central thickness Di is determined.

In a fourth step (block 56), outer contour 42 of second member 26 is determined, starting from an initial position of polishing tool 22 on surface 16.

In a fifth step (block 58), the mean elastic deflection di of second member 26 is calculated with the assumption of a constant thickness Di, and with the given values from the third step (block 54) according to the following formula $$di=pm*Di/E$$

In a sixth step (block 60), the polishing movement of polishing tool 22 on surface 16 to be polished is determined.

In a seventh step (block 62), this polishing movement is subdivided into a sufficient high number n of small incremental movements.

In an eighth step (block 64), the deviations in z-direction z_D(h) and z_D(x,y), resp., between outer contour 42 of second member 26 being shifted and/or rotated with respect to surface 16 to be polished, is calculated at a position i. This is the local elastic deflection area.

In a ninth step (block 66), these deviations z_D(h) and z_D(x,y), resp., are summed up at all incremental motional intermediate positions. This is done component-wise in the respective polar coordinate system or Cartesian coordinate system.

In a tenth step (block 68), the minimum elastic deflection z_Dmin is held, and, correspondingly, in an eleventh step (block 69), the maximum elastic deflection z_Dmax is held.

In a twelfth step (block 76), finally, the tilting and the central offset of the averaged aspheric deformation area is subtracted, and one obtains a value z_Dmt.

The necessary iterations are effected via loops 74, 78, and 80.

With the value z_Dmt one can now proceed according to two different variants, being designated in blocks 84 and 86 with their corresponding equations IV to IX and X to XIII, resp.

According to variant A, outer contour 42 is initially corrected by the value z_Dmt, for compensating the averaged deviations in elastic deflection, namely for a round polishing tool 22:

$$K2(h)=K2(h)+z_Dmt(h) \quad \text{(IV)}$$

and for out of round polishing tools 22, resp.:

$$K2(x,y)=K2(x,y)+z_Dmt(x,y)$$

The dynamical deviations, not yet compensated, are reduced through the function of the thickness D of second member 26, namely for round polishing tools 22:

$$D(h)=Di+Di*(z_D\max(h)-z_D\min(h))/di/f_a; \textit{ resp.},$$

and for out of round polishing tools 22, resp.:

$$D(x,y)=Di+Di*(z_D\max(x,y)-z_D\min(x,y))/di/f_a$$

Therefore, variant A entirely compensates the mean dynamic elastic deviation and reduces the dynamic elastic pressure deviation through the function of the thickness D of second member 26. Inner contour 41 (identified as K1 in this context) then results for round polishing tools 22 as:

$$K1(h)=K2(h)+D(h)$$

and for out of round polishing tools 22, resp.:

$$K1(x,y)=K2(x,y)+D(x,y).$$

In variant B, outer contour 42 remains uncorrected. One can then reduce the mean elastic deviations z_Dmt through the function of the thickness D of second member 26 for round polishing tools 22:

$$D(h)=Di+Di*z_Dmt(h)/di/f_a$$

and for out of round polishing tools 22, resp.:

$$D(x,y)=Di+Di*z_Dmt(x,y)/di/f_a$$

Inner contour 40 and K1, resp., then result for round polishing tools 22:

$$K1(h)=K2(h)+D(h)$$

and for out of round polishing tools 22, resp.:

$$K1(x,y)=K2(x,y)+D(x,y).$$

When doing so, factor f_a is used being a factor alloted to the aspheric type. This factor may, preferably, be between ½ and 2. The dynamic elastic pressure variations are not compensated in this variant.

EXAMPLES

The dimensioning of second member 26 is effected for the machining of a toric aspheric surface of a spectacle lens according to variant B. the starting point is a toric surface with the radii R1=100 mm and R2=150 mm. For a toric spectacle lens surface, a base radius RB of 150 mm with a refractive index of 1.6 corresponds to a lens power of 4 diopters. A cylinder radius RZ of 100 mm for the same fractive index corresponds to a lens power of 6 diopters. Such an aspheric toric surface, therefore, establishes a cylindrical lens power of 2 diopters. More than 90% of all spectacle lenses have a cylindrical effect of less than 2 diopters. The asphericity of the described torus in a diameter range of 45 mm is about 900 μm.

The application force is assumed to be Fk=90.478 N. With a diameter of the contact surface of Dm=45 mm, a mean polishing pressure pm=0.057 $N/mm^2$ is exerted.

The modulus of elasticity is selected to be E=0.25 $N/mm^2$. The central thickness Di of second member 26 is 4 mm.

It is, initially, assumed that contours 40 and 42 are identical and correspond to the radius of the spheric area of RB=RZ=150 mm. In an ideal situation, one, thereby, obtains a constant polishing pressure.

Example 1

Prior Art

A polishing tool 22 is conventionally applied under pressure against the above-mentioned surface with the radii 100/150 mm under the assumption of constant thickness D of second element 26 being 4 mm. The radii of contours 40 and 42 are identical and are selected such that they are positioned between the two radii of the torus. It then becomes apparent that the fluctuations in polishing pressure within the outer area amount to at least 96% of the average polishing pressure. This results in a strong discontinuous removal of material during the polishing and is contra-productive with respect to a steady polishing and smoothing action. One has to expect a strongly fluctuating polishing process.

Example 2

Invention

According to the invention, a second member 26 is used being optimized in the radial function of its thickness Di. Thickness Di increases from 4 mm in the center to DR=10 mm at the periphery. The factor f_a in this instance is selected to be f_a=⅔. The radii of contours 40 and 42 are calculated such that outer contour 42 applies somewhat flatter than base radius RB and that the radius of inner contour 40, accordingly, compensates the difference in thickness from the center outwardly. The polishing pressure that is now calculated, is reduced in its dynamics to less than 40% of the average polishing pressure pm.

Example 3

Invention

If a second member 26 is selected, becoming thicker from Di=4 mm to DR=8 mm, and the radii of contours 40 and 42 are dimensioned as in the preceding calculation, then the fluctuation of the polishing pressure is less than 47%, when the factor f_a=1 is assumed.

The invention claimed is:

1. An apparatus for polishing an optical surface, comprising a polishing head having a polishing tool, said polishing tool being provided along a common axis with a first, essentially rigid, member, a second elastic member, and a polishing lining, each extending essentially radially relative to said axis, wherein said second elastic member is configured to have an increasing axial thickness in a radial direction, and to be increasingly soft in a radial outward direction.

2. The apparatus of claim 1, wherein said second elastic member adjoins said first member with an inner contour and adjoins said polishing lining with an outer contour, a function of said axial thickness vs. said radial direction being determined depending on a radial function of said contours.

3. The apparatus of claim 2, wherein said inner contour is configured convex and said outer contour is configured convex.

4. The apparatus of claim 2, wherein said inner contour is convex and said outer contour is configured plane.

5. The apparatus of claim 2, wherein said inner contour is configured concave and said outer contour is configured concave.

6. The apparatus of claim 2, wherein said inner contour is configured plane and said outer contour is configured concave.

7. The apparatus of claim 2, wherein said inner contour is configured convex and said outer contour is configured concave.

8. The apparatus of claim 2, wherein said outer contour is configured spheric.

9. The apparatus of claim 2, wherein said outer contour is configured aspheric.

10. The apparatus of claim 2, wherein said outer contour is configured as a free-form surface.

11. A method of manufacturing a polishing tool, said polishing tool being provided along a common axis with a first, essentially rigid, member, a second elastic member, and a polishing lining, each extending essentially radially relative to said axis, wherein said second elastic member is made increasingly soft in a radial outward direction in a manner such that when said tool is applied against said optical surface with a predetermined application force said application force is transferred homogeneously to said optical surface, wherein said second elastic member is manufactured to be continuously increasingly soft in a radial outward direction and to adjoin said first member with an inner contour and to adjoin said polishing lining with an outer contour, a function of said axial thickness vs. said radial direction being determined depending on a radial function of said contours, and further comprising the steps of:

a) Determining a desired medium polishing pressure pm of said polishing tool;

b) Determining a necessary application force Fk from said polishing area of said polishing tool;

c) Selecting a modulus of elasticity E for a material of said second elastic member;

d) Selecting a central thickness Di of said second elastic member;

e) Selecting an initial outer contour;

f) Calculating a central elastic deflection di for said second elastic member under an assumption that said second elastic member has a constant axial thickness D being equal to said central thickness Di;

g) Determining a polishing movement of said polishing tool on said surface to be polished;

h) Subdividing said polishing movement into a predetermined number n of motion increments, said number n being elected sufficiently high;

i) Calculating an elastic deflection area from deviations of said axial thickness z_Di in a direction z of said axis between said surface and said outer contour in a predetermined point i during a relative polishing movement between said polishing tool and said optical surface;

j) Adding said deviations z_Di at all points i;

k) Determining a maximum deviation z_Dmax;

l) Determining a minimum deviation z_Dmin;

m) Determining a mean value z_Dm from all deviations z_Di;

n) Establishing a difference z_Dmt between said mean value z_Dm and a sum of a tilting and a central offset of said mean value z_Dm;

o) Calculating said axial thickness D as a function of said radial direction h for round and out of round polishing tools, resp., with the sub-steps of:

$K2(h)=K2(h)+z_Dmt(h)$; and $K2(x,y)=K2(x,y)+z_Dmt(x,y)$, *resp.;*

$D(h)=Di+Di*(z_D\max(h)-z_D\min(h))/di/f_a$; and $D(x,y)=Di+Di*(z_D\max(x,y)-z_D\min(x,y))/di/f_a$, *resp.;*

$K1(h)=K2(h)+D(h)$; and $K1(x,y)=K2(x,y)+D(x,y)$, *resp.*

12. A method of manufacturing a polishing tool, said polishing tool being provided along a common axis with a first, essentially rigid, member, a second elastic member, and a polishing lining, each extending essentially radially relative to said axis, wherein said second elastic member is made increasingly soft in a radial outward direction in a manner such that when said tool is applied against said optical surface with a predetermined application force said application force is transferred homogeneously to said optical surface, and further comprising the steps of:

a) Determining a desired medium polishing pressure pm of said polishing tool;

b) Determining a necessary application force Fk from said polishing area of said polishing tool;

c) Selecting a modulus of elasticity E for a material of said second elastic member;

d) Selecting a central thickness Di of said second elastic member;

e) Selecting an initial outer contour;

f) Calculating a central elastic deflection di for said second elastic member under an assumption that said second member has a constant axial thickness D being equal to said central thickness Di;

g) Determining a polishing movement of said polishing tool on said surface to be polished;

h) Subdividing said polishing movement into a predetermined number n of motion increments, said number n being elected sufficiently high;

i) Calculating an elastic deflection area from deviations of said axial thickness z_Di in a direction z of said axis between said surface and said outer contour in a predetermined point i during a relative polishing movement between said polishing tool and said optical surface;

j) Adding said deviations z_Di at all points i;

k) Determining a maximum deviation z_Dmax;

l) Determining a minimum deviation z_Dmin;

m) Determining a mean value z_Dm from all deviations z_Di;

n) Establishing a difference z_Dmt between said mean value z_Dm and a sum of a tilting and a central offset of said mean value z_Dm;

o) Calculating said axial thickness D as a function of said radial direction h for round and out of round polishing tools, resp., with the sub-steps of:

$$D(h)=Di+Di*z_Dmt(h)/di/f_a; \text{ and} \quad (X)$$

$$D(x,y)=Di+Di*z_Dmt(x,y)/di/f_a, \text{ resp.;} \quad (XI)$$

$$K1(h)=K2(h)+D(h); \text{ and} \quad (XII)$$

$$K1(x,y)=K2(x,y)+D(x,y), \text{ resp.} \quad (XIII)$$

13. An apparatus for polishing an optical surface, comprising a polishing head having a polishing tool, said polishing tool being provided along a common axis with a first, essentially rigid, member, a second elastic member, and a polishing lining, each extending essentially radially relative to said axis, wherein said second elastic member is configured to be increasingly soft in a radial outward direction in a manner such that when said tool is applied against said optical surface with a predetermined application force said application force is transferred homogeneously to said optical surface, and wherein said second member adjoins said first member with an inner contour and adjoins said polishing lining with an outer contour, a function of said axial thickness vs. said radial direction being determined depending on a radial function of said contours as follows:

a) Determining a desired medium polishing pressure pm of said polishing tool;

b) Determining a necessary application force Fk from said polishing area of said polishing tool;

c) Selecting a modulus of elasticity E for a material of said second elastic member;

d) Selecting a central thickness Di of said second elastic member;

e) Selecting an initial outer contour;

f) Calculating a central elastic deflection di for said second elastic member under an assumption that said second member has a constant axial thickness D being equal to said central thickness Di;

g) Determining a polishing movement of said polishing tool on said surface to be polished;

h) Subdividing said polishing movement into a predetermined number n of motion increments, said number n being elected sufficiently high;

i) Calculating an elastic deflection area from deviations of said axial thickness z_Di in a direction z of said axis between said surface and said outer contour in a predetermined point i during a relative polishing movement between said polishing tool and said optical surface;

j) Adding said deviations z_Di at all points i;

k) Determining a maximum deviation z_Dmax;

l) Determining a minimum deviation z_Dmin;

m) Determining a mean value z_Dm from all deviations z_Di;

n) Establishing a difference z_Dmt between said mean value z_Dm and a sum of a tilting and a central offset of said mean value z_Dm;

o) Calculating said axial thickness D as a function of said radial direction h for round and out of round polishing tools, resp., with the sub-steps of:

$K2(h)=K2(h)+z_Dmt(h)$; and $K2(x,y)=K2(x,y)+z_Dmt(x,y)$, *resp.;*

$D(h)=Di+Di*(z_D\max(h)-z_D\min(h))/di/f_a$; and $D(x,y)=Di+Di*(z_D\max(x,y)-z_D\min(x,y))/di/f_a$, *resp.;*

$K1(h)=K2(h)+D(h)$; and $K1(x,y)=K2(x,y)+D(x,y)$, *resp.*

14. An apparatus for polishing an optical surface, comprising a polishing head having a polishing tool, said polishing tool being provided along a common axis with a first, essentially rigid, member, a second elastic member, and a polishing lining, each extending essentially radially relative to said axis, wherein said second elastic member is configured to be increasingly soft in a radial outward direction in a manner such that when said tool is applied against said optical surface with a predetermined application force said application force is transferred homogeneously to said optical surface, and wherein said second member adjoins said first member with an inner contour and adjoins said polishing lining with an outer contour, a function of said axial thickness vs. said radial direction being determined depending on a radial function of said contours as follows:

a) Determining a desired medium polishing pressure pm of said polishing tool;

b) Determining a necessary application force Fk from said polishing area of said polishing tool;

c) Selecting a modulus of elasticity E for a material of said second elastic member;

d) Selecting a central thickness Di of said second elastic member;

e) Selecting an initial outer contour;

f) Calculating a central elastic deflection di for said second elastic member under an assumption that said second member has a constant axial thickness D being equal to said central thickness Di;

g) Determining a polishing movement of said polishing tool on said surface to be polished;

h) Subdividing said polishing movement into a predetermined number n of motion increments, said number n being elected sufficiently high;

i) Calculating an elastic deflection area from deviations of said axial thickness z_Di in a direction z of said axis between said surface and said outer contour in a predetermined point i during a relative polishing movement between said polishing tool and said optical surface;

j) Adding said deviations z_Di at all points i;

k) Determining a maximum deviation z_Dmax;

l) Determining a minimum deviation z_Dmin;

m) Determining a mean value z_Dm from all deviations z_Di;

n) Establishing a difference z_Dmt between said mean value z_Dm and a sum of a tilting and a central offset of said mean value z_Dm;

o) Calculating said axial thickness D as a function of said radial direction h for round and out of round polishing tools, resp., with the sub-steps of:

$$D(h)=Di+Di*z_Dmt(h)/di/f_a; \text{ and} \quad (X)$$

$$D(x,y)=Di+Di*z_Dmt(x,y)/di/f_a, \text{ resp.;} \quad (XI)$$

$$K1(h)=K2(h)+D(h); \text{ and} \quad (XII)$$

$$K1(x,y)=K2(x,y)+D(x,y), \text{ resp.} \quad (XIII)$$

15. The apparatus of claim 1, wherein said second member is configured such that when said tool is applied against said optical surface with a predetermined application force said application force is transferred homogeneously to said optical surface.

16. An apparatus for polishing an optical surface, comprising a polishing head having a polishing tool, said polishing tool being provided along a common axis, and one behind another, with a first, essentially rigid, member, a second, elastic member, and a polishing lining, each extending essentially radially relative to said axis, wherein said second member is configured to be increasingly soft in a radial outward direction in a manner such that when said tool is applied against said optical surface with a predetermined application force said application force is transferred homogeneously to said optical surface, and wherein, further, said second member has an inner contour adjoining said first member that is configured convex and an outer contour adjoining said polishing lining that is configured convex.

17. An apparatus for polishing an optical surface, comprising a polishing head having a polishing tool, said polishing tool being provided along a common axis, and one behind another, with a first, essentially rigid, member, a second, elastic member, and a polishing lining, each extending essentially radially relative to said axis, wherein said second member is configured to be increasingly soft in a radial outward direction in a manner such that when said tool is applied against said optical surface with a predetermined application force said application force is transferred homogeneously to said optical surface and wherein, further, said second member has an inner contour adjoining said first member that is configured concave and an outer contour adjoining said polishing lining that is configured concave.

* * * * *